United States Patent [19]

Schedele

[11] Patent Number: 4,609,896

[45] Date of Patent: Sep. 2, 1986

[54] POLARIZED ELECTROMAGNETIC MINIATURE RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 746,125

[22] Filed: Jun. 18, 1985

[30] Foreign Application Priority Data

Jul. 3, 1984 [DE] Fed. Rep. of Germany ..... 3424464

[51] Int. Cl.[4] ..... H01H 51/22

[52] U.S. Cl. ..... 335/80; 335/230

[58] Field of Search ..... 335/78, 80, 81, 84, 335/229, 230

[56] References Cited

U.S. PATENT DOCUMENTS 4,075,585 2/1978 Sauer ..... 335/78

4,091,346 5/1978 Nishimura et al. ..... 335/78

*Primary Examiner*—George Harris

*Attorney, Agent, or Firm*—Hill, Van Santen, Steadman & Simpson

[57] ABSTRACT

A polarized miniature relay incorporates a rod-shaped armature pivotally mounted at one end and axially arranged within the coil member with its free end projecting between two oppositely magnetically polarized pole shoes coupled with two opposite poles of a quadripole permanent magnet. A flux plate is connected to the other poles of the permanent magnet and has an aperture which supports the armature for pivoting motion in contact therewith. A very low reluctance for the magnetic circuit results in the magnetic flux paths of the relay.

6 Claims, 6 Drawing Figures

POLARIZED ELECTROMAGNETIC MINIATURE RELAY

BACKGROUND OF THE INVENTION

1. Field of the Invention

The present invention relates to a magnetic relay and more particularly to a polarized electromagnetic miniature relay.

2. Prior Art

Polarized electromagnetic relays have been proposed in which a rod-shaped armature is arranged axially inside an energization coil, such armature having a free end projecting into the space between two oppositely magnetically polarized shoes. The shoes are magnetically coupled with two nonhomonymous poles of a quadripole permanent magnet. The other two poles of the permanent magnet are magnetically coupled with one another via a flux plate which is magnetically coupled to a bearing region of the armature. A relay of this type is described in German OS No. 31 32 239 and German OS No. 31 32 244. As proposed, the supported end of the armature is anchored in an insulating carrier which is rotatably mounted in extensions of the coil member by means of bearing members. The flux plate is separated from the armature by an air gap, so as not to introduce friction which would impede the armature from moving. This air gap prevents the magnetic circuit and the excitation circuit from being completely closed, with the result that a relatively large excitation power is required, and a relatively low contact force is supplied on actuation. In addition, the bearing arrangement between the insulating carrier of the armature and the coil member necessitates a relatively complicated mechanical arrangement.

It is therefore desirable to provide a relay in which the magnetic circuit is closed, and the mechanical bearing arrangement for the armature is simplified.

BRIEF DESCRIPTION OF THE INVENTION

A principal object of the present invention is to provide a polarized magnetic relay in which the magnetic circuit is closed, and a simplified support is provided for the armature.

In accordance with the present invention, these objects are achieved by employing an arrangement incorporating a flux plate having an opening for receiving a section of the armature, so that the armature is pivoted on the flux plate in mechanical contact therewith.

The arrangement of the present invention provides an improved magnetic flux transition, and accordingly operates with lower power control signals. In addition, the length of the flux path is shorter than in the case of the previously proposed relay, so that less leakage flux is lost. Since the armature is mounted directly on the flux plate, the coil member and support can be more simply designed and their materials can be selected without regard for sliding properties because there is no frictional contact between the coil member or its support and the armature. For example, a temperature-resistant material may be employed for the coil winding and its support.

The simplification of the bearing construction and the improvement of the coupling achieved by the present invention are significant in that tolerances may be reduced, and also relays with the construction of the present invention may be manufactured in extremely small sizes on the order of about 1 cubic centimeter. In such sizes, tolerances of fractions of a millimeter have considerable effect on the operation and reliability of the relays.

In a more specific development of the invention, the armature is prismatically tapered in the region of the opening of the flux plate, so that the flux plate narrowly surrounds the armature in the region of its pivot axis without being obstructed in its switching movement. Alternatively, the opening in the flux plate may be conically shaped. The armature itself is formed in the shape of a T, in the vicinity of the flux plate, so that it rests with the relatively long bearing edge on the flux plate, and can roll relative to the flux plate.

In a further embodiment, the armature is anchored in an insulating body which incorporates one or more contact springs extending axially parallel adjacent the coil. The armature can be supported in its bearing position by means of resilient conducting members connected with the contact springs. Independently of the springs however, the armature is drawn into its bearing position on the flux plate by means of the flux generated by the permanent magnet.

These and other objects and advantages of the present invention will be made manifest by a review of the following description and the accompanying drawings.

BRIEF DESCRIPTION OF THE DRAWINGS

Reference will now be made to the accompanying drawings in which.

DESCRIPTION OF THE PREFERRED EMBODIMENTS

Figure 1:
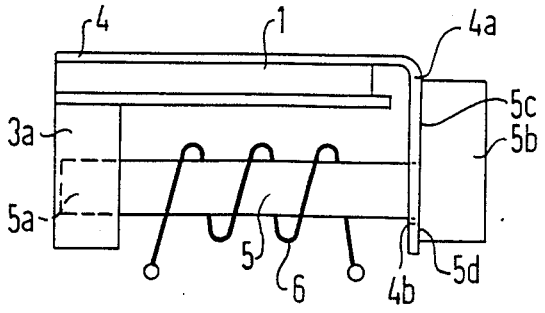
FIGS. 1 and 2 illustrate schematically the construction of a magnetic system for a relay incorporating the present invention.
Figure 2:
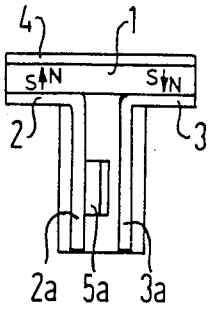

Referring to FIGS. 1 and 2, a polarized magnetic system is illustrated schematically. It consists of a permanent magnet 1 which has four poles with two opposite polarization directions, as illustrated in FIG. 2. On the two lower poles of the magnet 1, two flux plates 2 and 3 are coupled. At one end of the relay, the front ends of the flux plates 2 and 3 are bent down inwardly parallel to each other, to form two parallel pole shoes 2*a* and 3*a*. The two upper poles of the permanent magnet 1 are coupled by a flux plate 4. This flux plate extends rearwardly and is bent down into an L-shape with an end section 4*a*. A longitudinally extending rod-shaped armature 5 is arranged generally parallel with the magnet 1 and is surrounded by an excitation coil 6. The armature is pivotally supported in an aperature 4*b* in the member 4*a* and its free end 5*a* extends between the pole shoes 2*a* and 3*a*. It is capable of pivoting motion relative to the flux plate member 4*a* so that the free end 5*a* can engage in contact with either of the pole shoes 2*a* and 3*a*. The armature has a T-shape expanded end 5*b* having edges 5*c* and 5*d* which rest directly against the section 4*a* so that a good flux transition between the flux plate and the armature is guaranteed.

Figure 3:
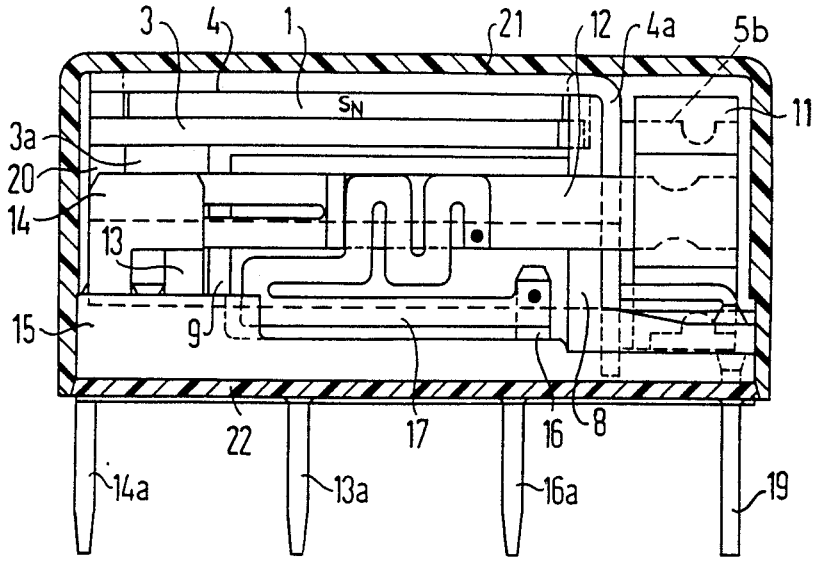
FIG. 3 illustrates a side-elevational view, partly in section, of a relay incorporating in the present invention.
Figure 4:
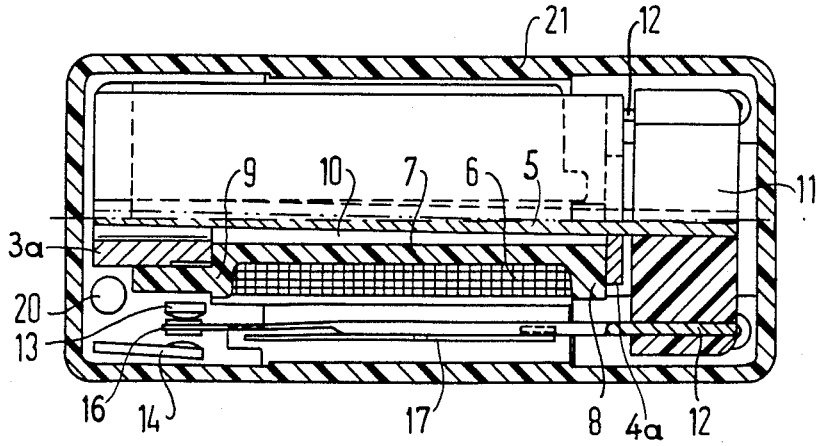
FIG. 4 illustrates a plan view, partly in section, of the relay illustrated in FIG. 3.

FIGS. 3 and 4 illustrate a complete relay incorporating the magnetic structure illustrated in FIGS. 1 and 2.

The same reference numerals are employed for corresponding parts. The winding 6 is supported by a coil support member 7 which has flanges 8 and 9 and its two opposite ends. The coil support member 7 has an axial bore 10 which surrounds the armature 5, as illustrated in FIG. 4. Pole shoes are provided corresponding to the pole shoes 2*a* and 3*a* of FIG. 2, although only a single shoe 3*a*, for clarity, is illustrated in FIGS. 3 and 4. The pole shoes are anchored in the region of the coil flange 9 and the coil support member, and the flux plate section 4*a* rests against the coil flange 8 at the opposite end of the coil support member 7.

The armature 5 is inserted through an opening corresponding to the opening 4*b* (FIGS. 1 and 2) in the flux plate 4, and is anchored with its T-shaped expanded end 5*b* in an insulating carrier 11 which bears a center contact spring 12 on both sides. These center contact springs 12 extend parallel to the armature adjacent the coil and, depending on the armature position, form contacts with fixed contacts 13 or 14 (only one pair illustrated in FIG. 4).

The coil support member 7 is seated on a base 15 which supports on both sides the fixed contact elements 13 and 14, with their respective contact lugs 13*a* and 14*a*, as well as a center contact connection 16 connected to a connection lug 16*a*. The center contact springs 12 are respectively connected by means of a flexible connection element 17 with their respective contact elements 16. The connection elements 17 (on both sides of the relay) simultaneously keep the armature in its bearing position. They can also exert a direction force on the armature by biasing the armature in one direction or the other, for the purpose of achieving a monostable switching characteristic.

Figure 5:
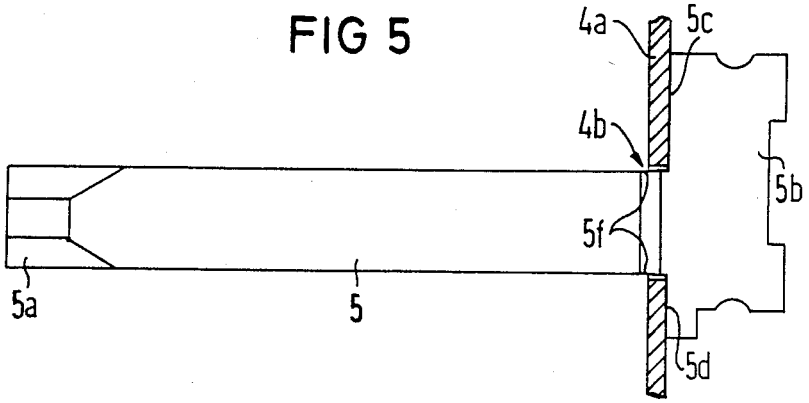
FIGS. 5 and 6 illustrate two views of an armature employed in the relay of FIGS. 3 and 4.
Figure 6:
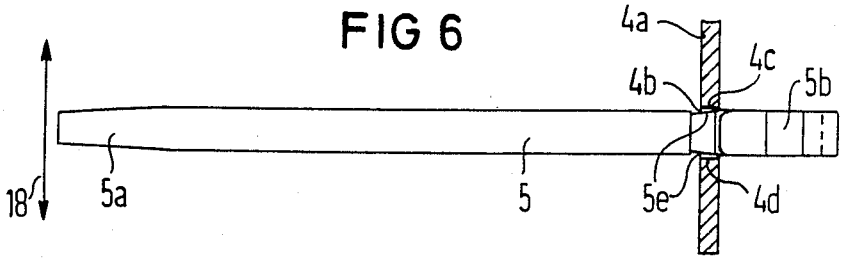

The armature 5 and a supporting arrangement is illustrated more clearly in FIGS. 5 and 6. It is shown in enlarged representation and lateral and plane views. The flux plate section 4*a* is shown with its aperature 4*b*, in with the armature 5 is pivotally supported. Pivoting movement is illustrated in FIG. 6 with a double arrow 18. In order to make possible a free switching movement of the armature in the opening 4*b*, the armature is slightly conically tapered in the region of this opening, so that a lateral surface 5*e* in the opening rests flat against the lateral wall 4*c* or 4*d* of the opening 4*b*, in either pivot position of the armature. Alternatively, the armature may remain with flat parallel walls, and the corresponding walls 4*c* and 4*d* of the opening 4*b* may be arranged conically, or prismatically, in order to achieve a flat contact surface when the armature is in either of its pivoted positions. Preferably the lateral surfaces 5*f* of the armature are angled slightly as shown in FIG. 5, to facilitate armature movement.

The contact springs 12 support the armature and the bearing through the connection elements 17. However, the armature is also attracted by means of the permanent magnet flux, through its T-shaped widened end 5*b*, to the flux plate section 4*a*. The front edges 5*c* of the widened end 5*b* are preferably rounded to facilitate the armature rolling on the flux plate section 4*a* while maintaining good magnetic contact with it.

In an alternative embodiment, the armature could be provided without the T-shaped expansion, whereby it could take any shape and be merely guided in rod-shaped fashion through the opening 4*b*. However, the flux transition would then be poorer. In this case, a rolling contact can be designed between the insulating carrier 11 and the flux plate section 4*a*, by providing the forward wall of the insulating carrier 11 with a curved surface, or providing a curved surface on the flux plate section 4*a*.

Preferably the relay also incorporates coil contacts connected to pins 19 (FIG. 4). Also, for optimizing the contact atmosphere, a column-shaped getter 20 is mounted on the base and is connected to electrical terminals by means not shown. The relay is preferably closed off with a cap 21 in conventional fashion and sealed off on the underside with sealing compound 22.

It is apparent that various modifications and additions may be made in the apparatus of the present invention without departing from the essential features of novelty thereof, which are intended to be defined and secured by the appended claims.

What is claimed is:

1. A polarized electromagnetic miniature relay comprising an excitation coil, a rod-shaped armature having at least a portion extending within said coil, means for pivotally mounting one end of said armature, a pair of magnetic pole shoes disposed on opposite sides of the free end of said armature, means for oppositely magnetically polarizing said pole shoes by magnetically coupling them with two non-homonymous poles of a quadripole permanent magnet, means connecting the other two poles of said permanent magnet to a flux plate having an aperture for receiving said armature and supporting said armature in pivotal relationship thereto.

2. A relay according to claim 1, wherein the aperture of the flux plate is prismatically tapered, whereby flat surface contact is provided between said armature and said flux plate when said armature is in either of its pivotal positions in which said free end is in contact with either one of said pole shoes.

3. The relay according to claims 1 or 2, including an insulating carrier mounted to the end of said armature opposite said free end, and including at least one contact spring mounted to said insulating carrier and extending parallel to said armature.

4. The relay according to claim 1 or 2, wherein said armature is formed in the shape of a T adjacent said aperture whereby bearing edges of said armature rest in contact with said flux plate section.

5. The relay according to claim 3, wherein said insulating carrier bears against said flux plate in pivotal relationship thereto.

6. The relay according to claim 3, including at least one resilient current supply element interconnected between said contact spring and an external electrical terminal.

* * * * *